US009227816B2

(12) United States Patent
Chen

(10) Patent No.: US 9,227,816 B2
(45) Date of Patent: Jan. 5, 2016

(54) VERTICAL SUPPORT STRUCTURE AND LIFTING DEVICE HAVING THE SAME

(71) Applicant: Min-Chin Chen, Kaohsiung (TW)

(72) Inventor: Min-Chin Chen, Kaohsiung (TW)

( * ) Notice: Subject to any disclaimer, the term of this patent is extended or adjusted under 35 U.S.C. 154(b) by 204 days.

(21) Appl. No.: 14/010,194

(22) Filed: Aug. 26, 2013

(65) Prior Publication Data

US 2014/0182977 A1 Jul. 3, 2014

(30) Foreign Application Priority Data

Dec. 27, 2012 (TW) ..... 101150441 A

(51) Int. Cl.
*B66B 11/04* (2006.01)
*B66B 9/02* (2006.01)

(52) U.S. Cl.
CPC ..... *B66B 11/0446* (2013.01); *B66B 9/025* (2013.01)

(58) Field of Classification Search
CPC ..... B66B 11/0446; B66B 9/025
USPC ..... 187/271
See application file for complete search history.

(56) References Cited

U.S. PATENT DOCUMENTS

| | | | | | |
|---|---|---|---|---|---|
| 828,029 | A * | 8/1906 | Jackson | 187/271 |
| 2,395,735 | A * | 2/1946 | Grigsby | 186/51 |
| 3,215,227 | A * | 11/1965 | MacChesney | 187/271 |
| 3,851,854 | A * | 12/1974 | Roybal | 254/7 C |
| 4,051,923 | A * | 10/1977 | Blanchette et al. | 187/271 |
| 4,287,967 | A * | 9/1981 | Perkins | 187/268 |
| 6,253,878 | B1 * | 7/2001 | Wells | 187/268 |
| 6,755,283 | B2 * | 6/2004 | Lin | 187/270 |
| 2013/0206514 | A1 * | 8/2013 | Kim et al. | 187/240 |
| 2015/0053036 | A1 * | 2/2015 | Chen | 74/424.82 |

FOREIGN PATENT DOCUMENTS

KR 1019990018735 * 4/2002

* cited by examiner

*Primary Examiner* — William A Rivera
*Assistant Examiner* — Michael Riegelman
(74) *Attorney, Agent, or Firm* — Birch, Stewart, Kolasch & Birch, LLP

(57) ABSTRACT

The vertical support structure includes a half tube and a mounting member. The half tube has an inner surface defining a receiving space and formed with a series of axially spaced-apart helical groove halves. The mounting member is connected to an outer surface of the half tube. A lifting device is also disclosed, and includes a plurality of the vertical support structures, a plurality of rotation units, a plurality of slide housings, a lift carrier, a drive motor and a plurality of transmission units.

4 Claims, 10 Drawing Sheets

VERTICAL SUPPORT STRUCTURE AND LIFTING DEVICE HAVING THE SAME

CROSS REFERENCE TO RELATED APPLICATION

This application claims priority of Taiwanese Patent Application No. 101150441, filed on Dec. 27, 2012.

BACKGROUND OF THE INVENTION

1. Field of the Invention

The invention relates to a lifting device, more particularly to a vertical support structure for use in an elevator or a mechanical parking equipment and a lifting device having the vertical support structure.

2. Description of the Related Art

Generally, an elevator or a mechanical parking equipment utilizes a drive member to pull steel ropes or chains so as to move the same. However, use of the steel ropes or chains is risky due to possible breakage thereof, so that there is a serious concern for safety during use of the elevator or the mechanical parking equipment.

SUMMARY OF THE INVENTION

Therefore, a main object of the present invention is to provide a vertical support structure and a lifting device that has the vertical support structure and that is safe to use.

According to one aspect of this invention, a vertical support structure comprises a half tube and a mounting member. The half tube has an inner surface defining a receiving space and formed with a series of axially spaced-apart helical groove halves. The mounting member is connected to an outer surface of the half tube.

According to another aspect of this invention, a lifting device comprises a plurality of vertical support structures, a plurality of rotation units, a plurality of slide housings, a lift carrier, a drive motor and a plurality of transmission units. Each of the vertical support structures includes a half tube having an inner surface defining a receiving space and formed with a thread unit, and a mounting member connected to an outer surface of the half tube. The thread unit includes a series of axially spaced-apart helical groove halves. Each of the rotation units is disposed in the receiving space and is movable along the length of the half tube. Each rotation unit is rotatably and threadedly engaged to the thread unit of the half tube of a respective vertical support structure. The slide housings respectively receive the rotation units and are respectively slidable relative to the half tubes of the vertical support structures to move upward and downward. The lift carrier has a carrier frame structure disposed between the vertical support structures. The carrier frame structure includes a plurality of connecting end portions connected to and riding on the slide housings, respectively. The drive motor is connected to the carrier frame structure. Each of the transmission units is connected between the drive motor and a respective one of the rotation units. When the drive motor is operated, the transmission units respectively drive the rotation units to rotate and move upward and downward along the helical groove halves in the half tubes of the vertical support structures simultaneously.

The efficiency of the present invention resides in that each vertical support structure is provided with the mounting member that is connected to the outer surface of the half tube so that fixing and assembly thereof on a wall surface or a surface of any fixed object can be facilitated, thereby enhancing the stability of each vertical support structure. Further, each vertical support structure is provided with the half tube to facilitate interconnection of the vertical support structures and to increase a moving path of each rotation unit, thereby achieving the purpose of enhancing the structural strength, connection convenience, and safe use of the lifting device.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
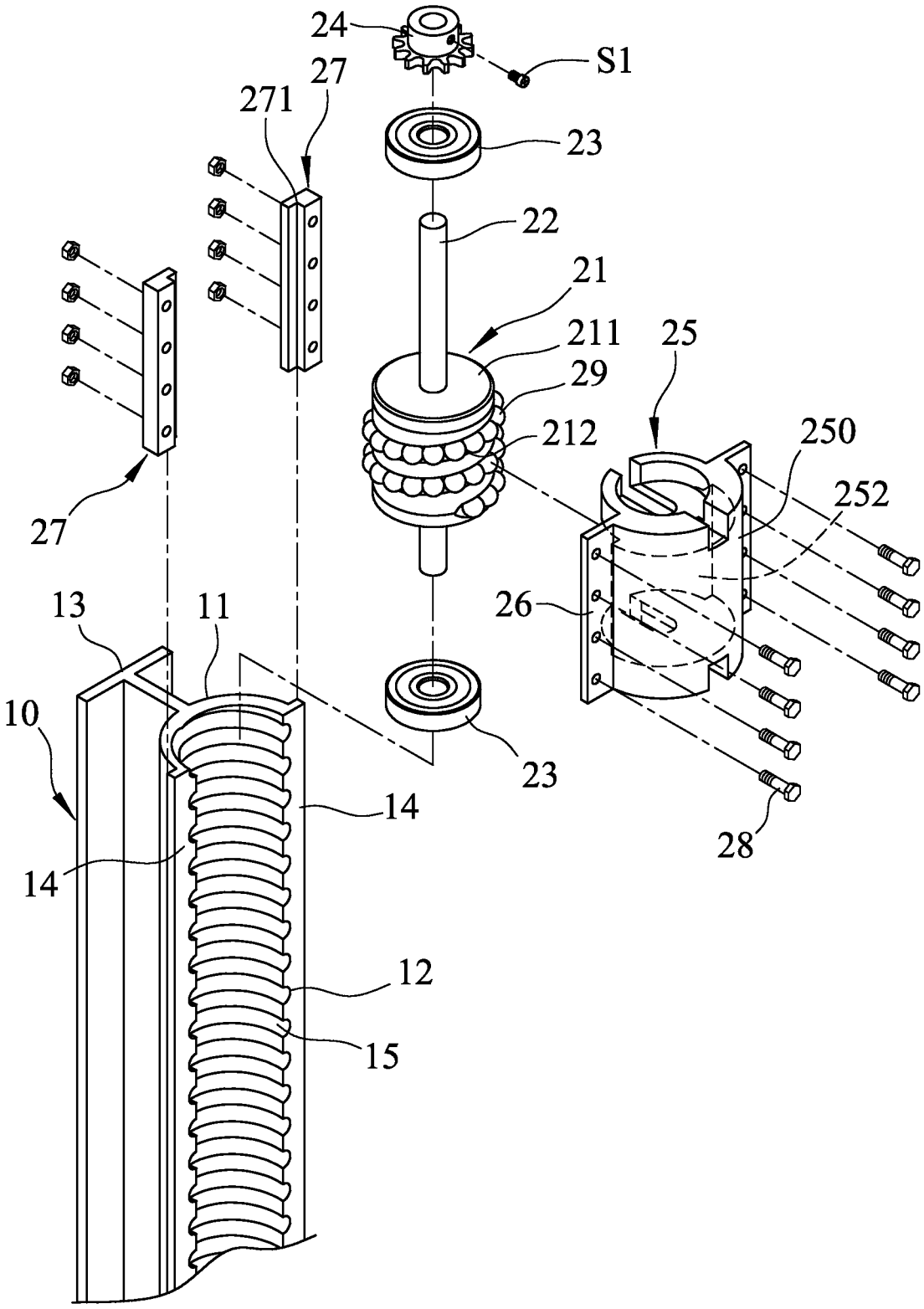
FIG. 1 is an exploded perspective view of a vertical support structure and a rotation unit of a lifting device according to a preferred embodiment of the present invention.
Figure 2:
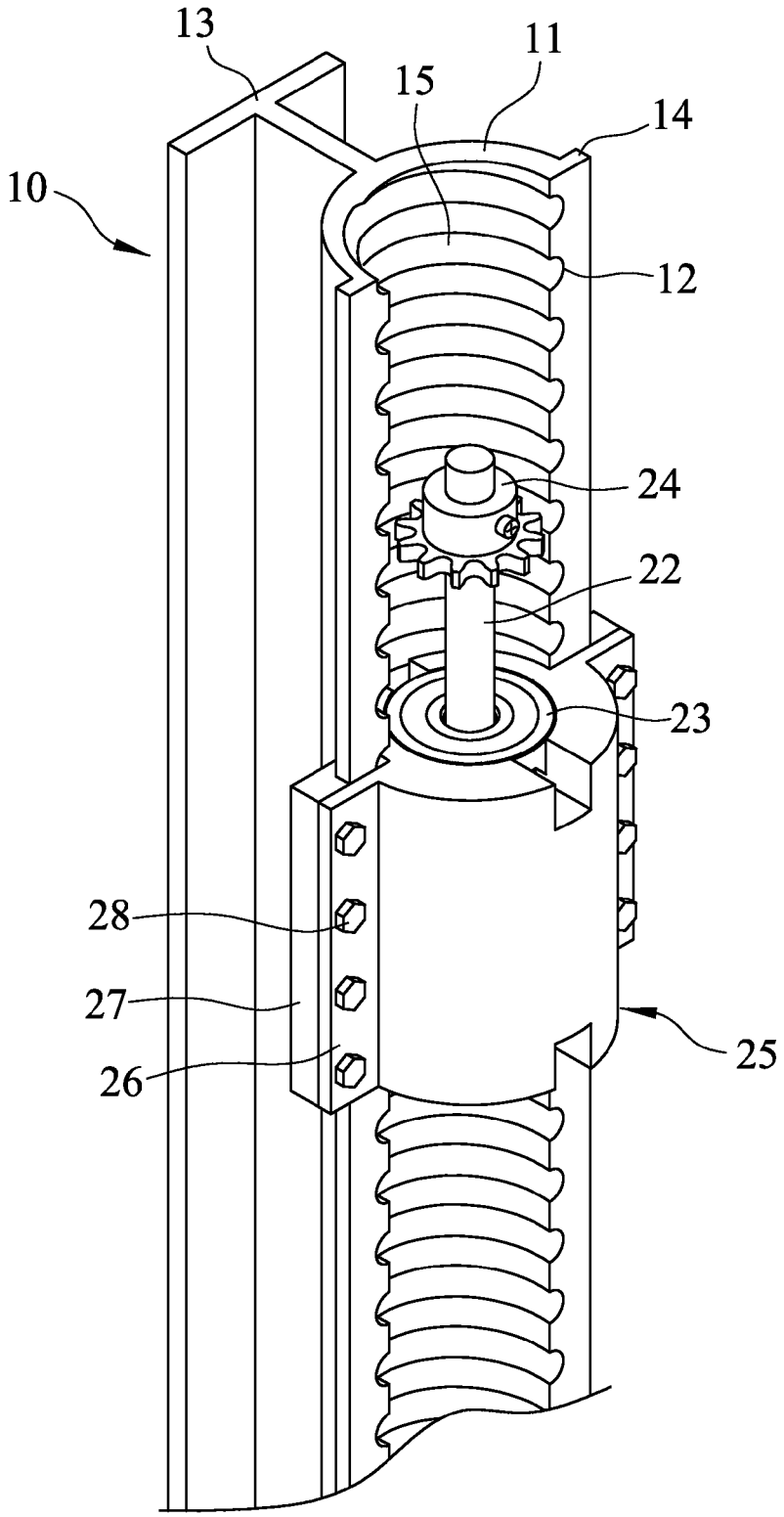
FIG. 2 is a perspective view of FIG. 1 in an assembled state.
Figure 3:
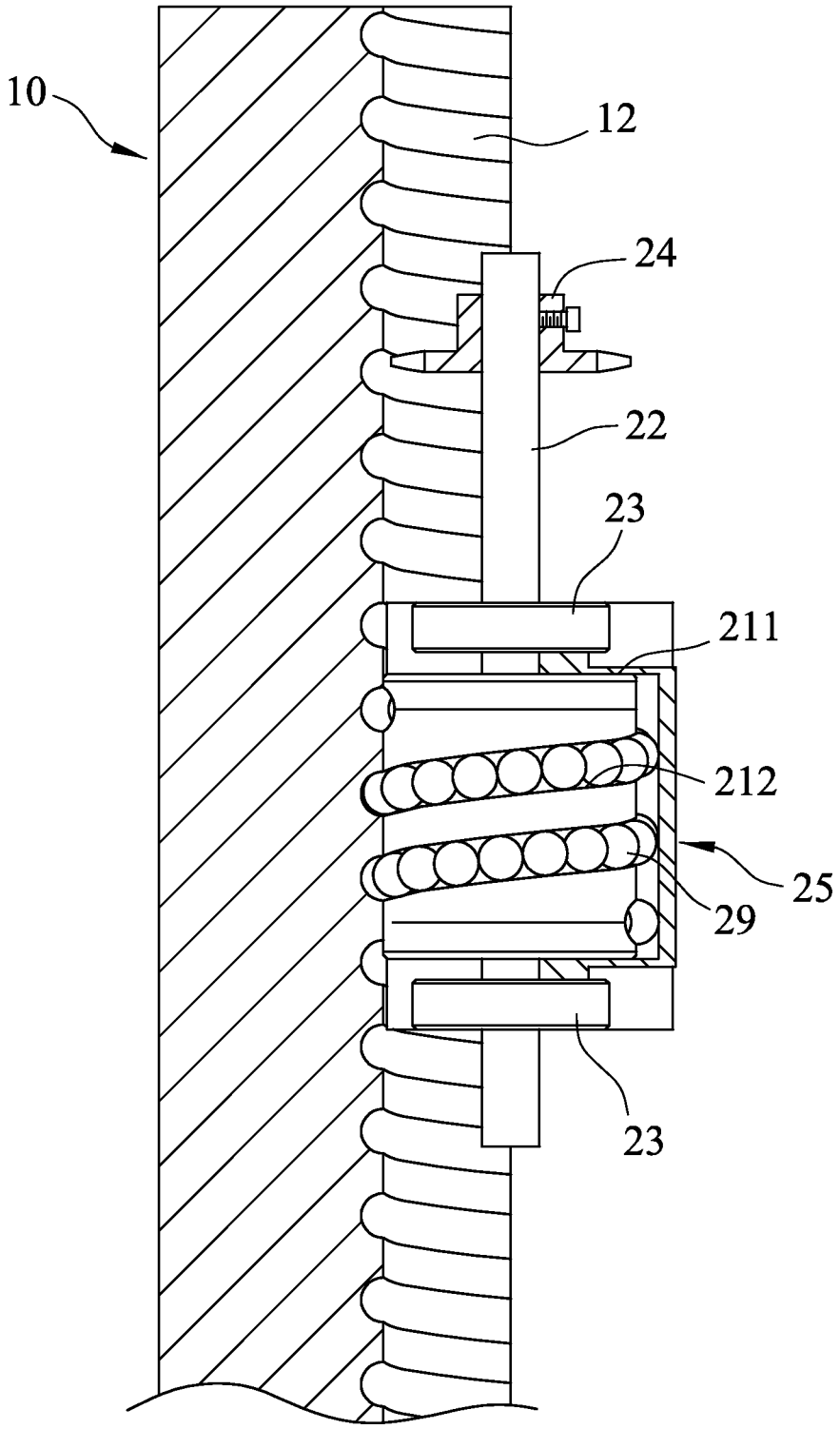
FIG. 3 is a sectional view of FIG. 1 in an assembled state.
Figure 4:
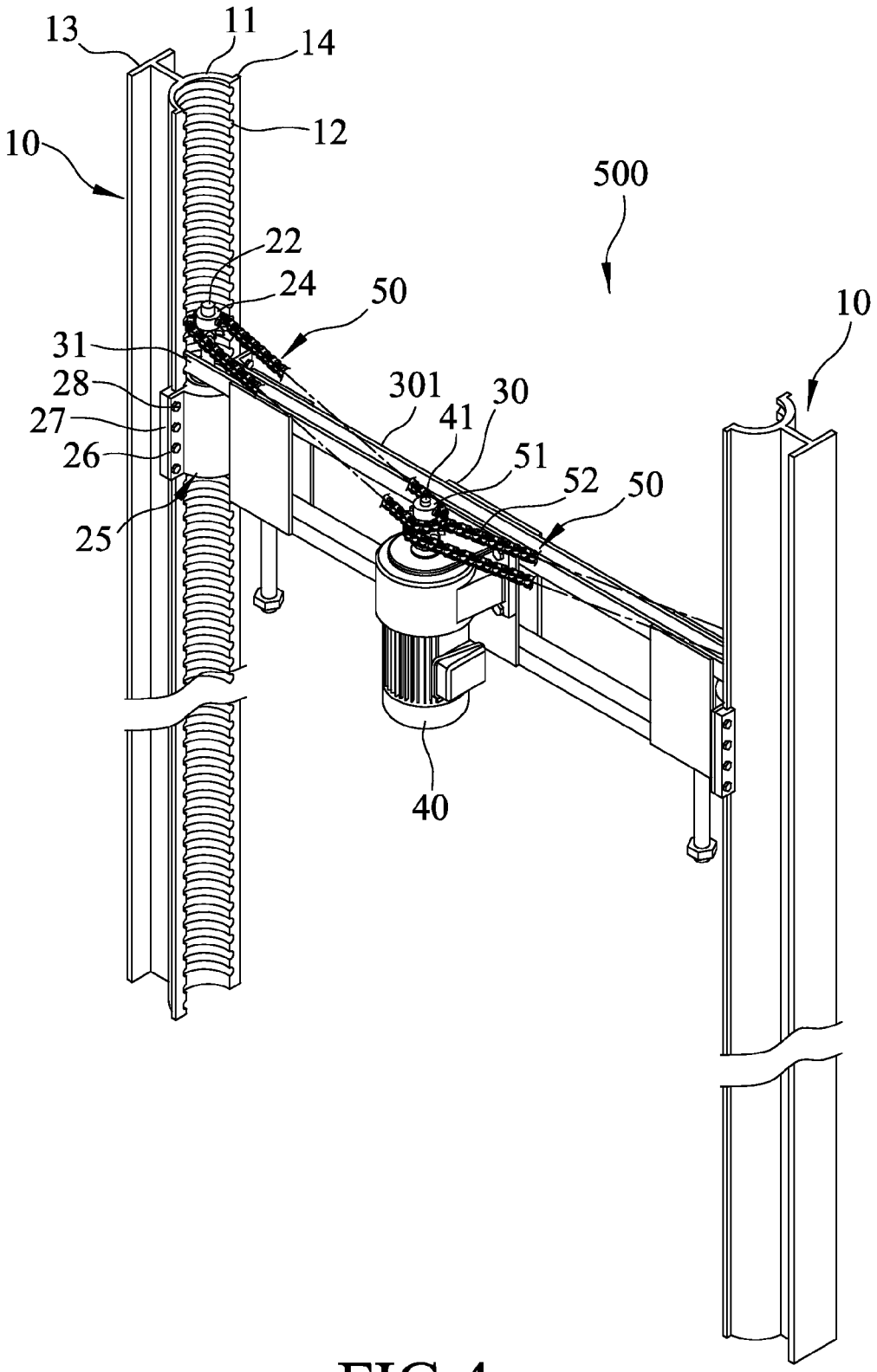
FIG. 4 is a fragmentary perspective view of the preferred embodiment, illustrating how components of the lifting device are interconnected.
Figure 5:
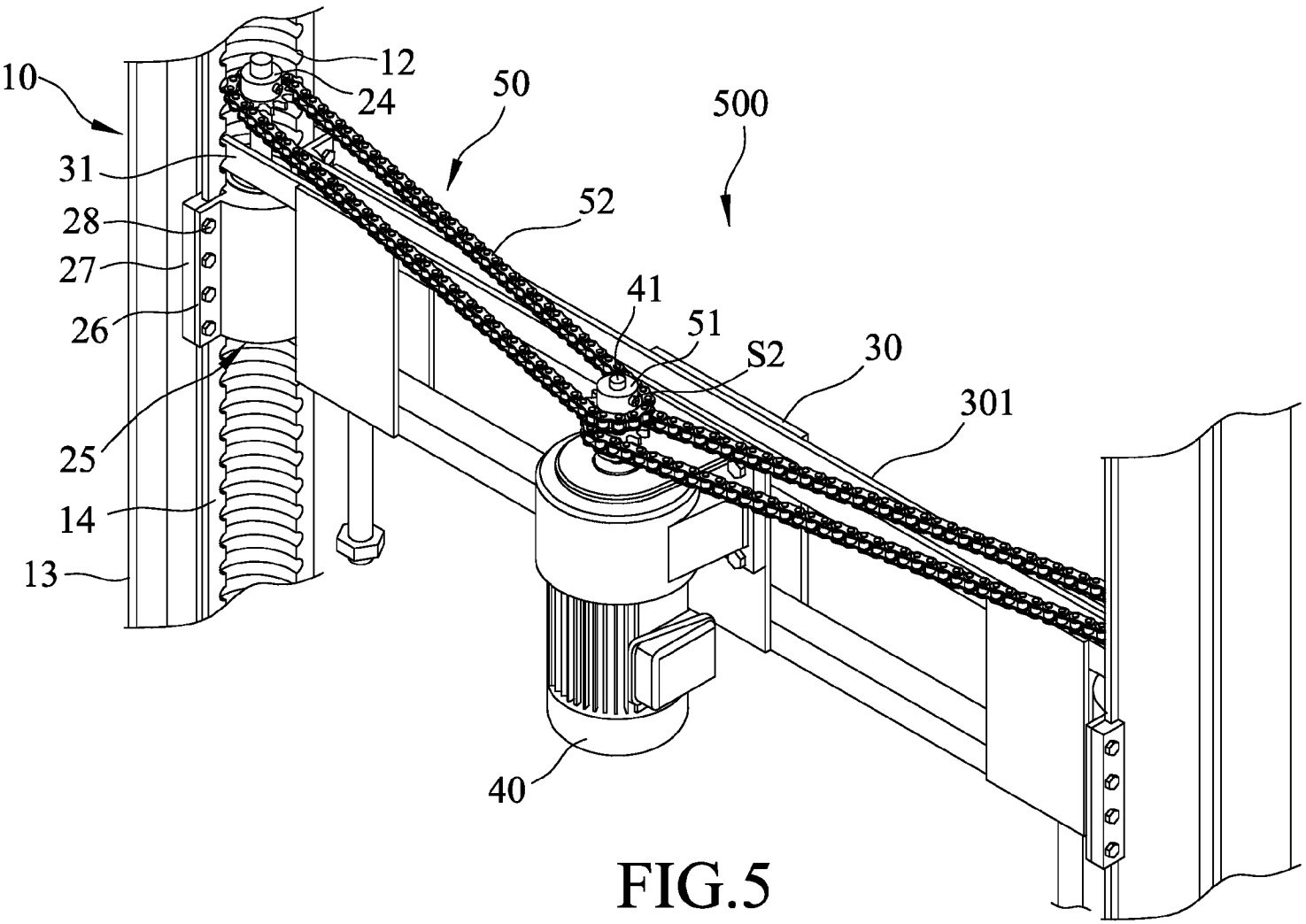
FIG. 5 is a fragmentary enlarged perspective view of FIG. 4.
Figure 6:
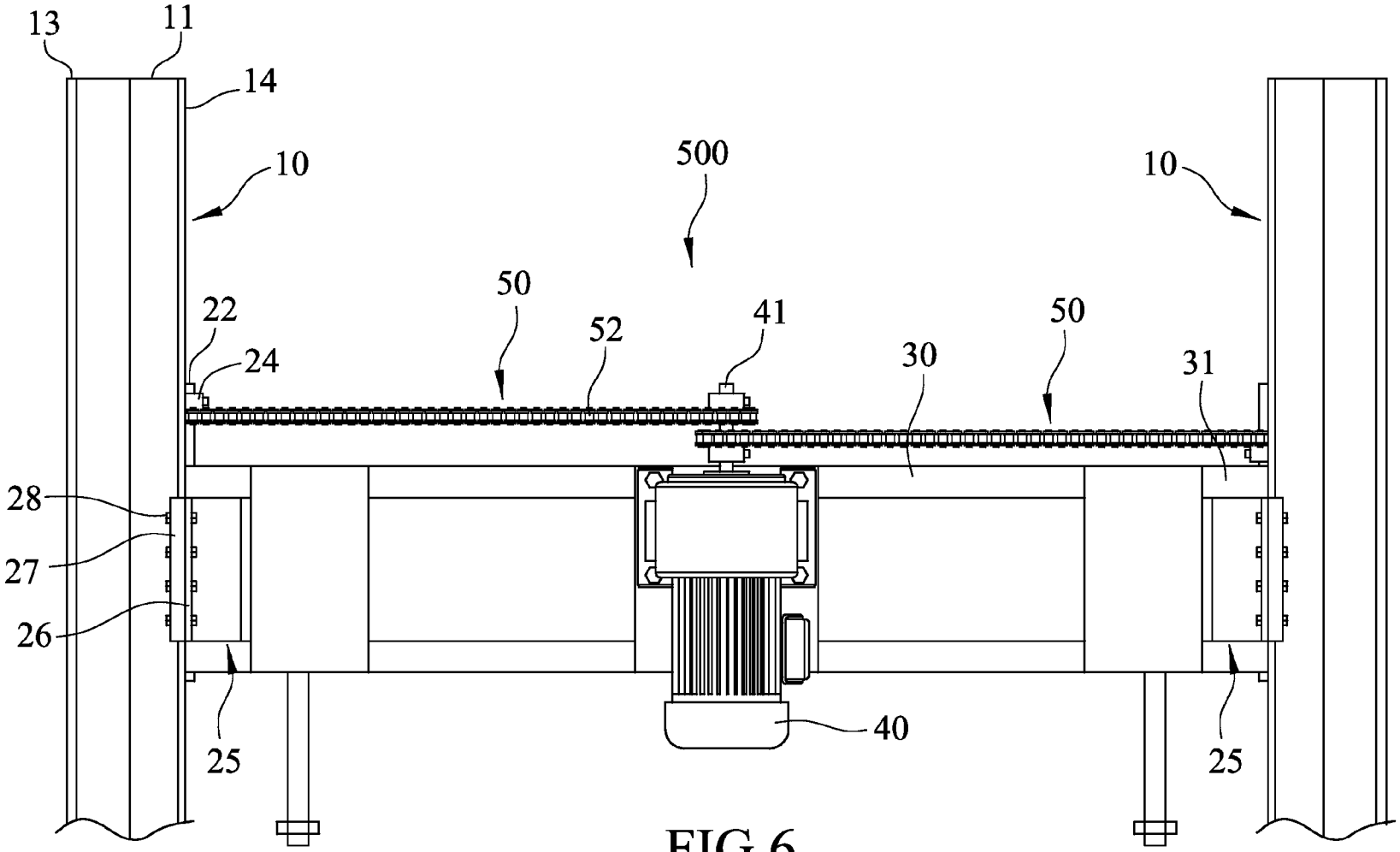
FIG. 6 is a schematic front view of FIG. 5.
Figure 7:
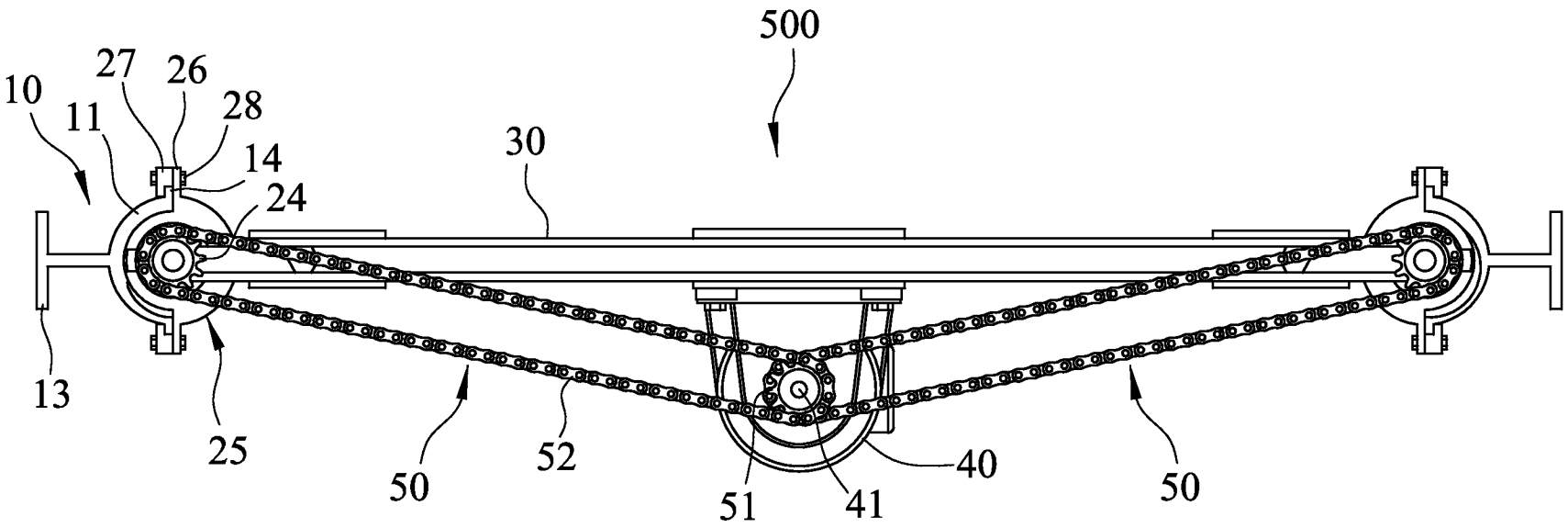
FIG. 7 is a schematic top view of FIG. 5.

Before the present invention is described in greater detail with reference to the accompanying preferred embodiments, it should be noted herein that like elements are denoted by the same reference numerals throughout the disclosure.

Referring to FIGS. 1 to 7, a lifting device 500 according to a preferred embodiment of the present invention comprises two vertical support structures 10, two rotation units 21, two slide housings 25, a lift carrier 30, a drive motor 40 and two transmission units 50.

Each of the vertical support structures 10 includes an elongated half tube 11 and an elongated mounting member 13. The half tube 11 has an inner surface defining a receiving space 15 and formed with a thread unit. The thread unit includes a series of axially spaced-apart helical groove halves 12 communicating with the receiving space 15. The half tube 11 further has two tube flanges 14 that project outwardly and radially from two radially opposite ends thereof, that extend along the length thereof, and that serve as a pair of slide rails. The mounting member 13 is connected to an outer surface of the half tube 11, and has a T-shaped cross section. The shape of the mounting member 13 may be varied according to the requirements.

Each of the rotation units 21 is disposed in the receiving space 15 of the half tube 11 of a respective vertical support structure 10, and is movable along the length of the half tube 11. Each rotation unit 21 includes a rotating block 211, a rotating shaft 22 extending through the rotating block 211 so that the rotating block 211 is sleeved fittingly on the rotating shaft 22, two shaft bearings 23 mounted on the rotating shaft 22 and located on top and bottom sides of the rotating block 211, and a driven sprocket 24 mounted on the rotating shaft 22 in proximity to a top one of the shaft bearings 23. The driven sprocket 24 is fixed to the rotating shaft 22 by using a screw (S1). The rotating block 211 has an outer surface formed with a helical groove 212. A plurality of bearing balls 29 are received in the helical groove 212, and serve as a helical thread that is engaged threadedly to the helical groove halves 12 in the half tube 11.

Each of the slide housings 25 receives therein a respective one of the rotation units 21, and is slidable relative to the half tube 11 of the respective vertical support structure 10 so as to move upward and downward. Particularly, each slide housing 25 has a substantially cylindrical housing body 250. The housing body 250 has a portion received in the receiving space 15, and includes a substantially cylindrical accommodation space 252 for accommodating the rotating block 211, two housing flanges 26 projecting outwardly and radially from two radially opposite ends of the housing body 250 and slidable along the tube flanges or slide rails 14, and two slide bars 27 respectively connected to the housing flanges 26 by using a plurality of fasteners 28 and respectively have a slide groove 271. The slide grooves 271 of the slide bars 27 are slidably engaged to the respective slide rails 14. Each of the shaft bearings 23 is disposed between the rotating shaft 22 and an inner surface of the housing body 250. When the rotating block 211 is received in the accommodation space 252, two opposite ends of the rotating shaft 22 extend out of the housing body 250, and the driven sprocket 24 is disposed externally of the housing body 250.

With reference to FIGS. 4 to 7, the lift carrier 30 has a carrier frame structure 301 disposed between the vertical support structures 10. The carrier frame structure 301 includes a plurality of connecting end portions 31 connected to and riding on the slide housings 25 of the vertical support structures 10.

The drive motor 40 is connected to the carrier frame structure 301, and has a motor shaft 41.

Each of the transmission units 50 is connected between the drive motor 40 and a respective rotation unit 21. Particularly, each transmission unit 50 includes a drive sprocket 51 and a drive chain 52. The drive sprocket 51 is fixed to the motor shaft 41 by using a screw (S2). The drive chain 52 is trained between the drive sprocket 51 and the driven sprocket 24 of the respective rotation unit 21. When the drive motor 40 is operated, the transmission units 50 respectively drive the rotation units 21 to rotate and move upward and downward along the helical groove halves 12 in the half tubes 11 of the respective vertical support structures 10 simultaneously.

Figure 8:
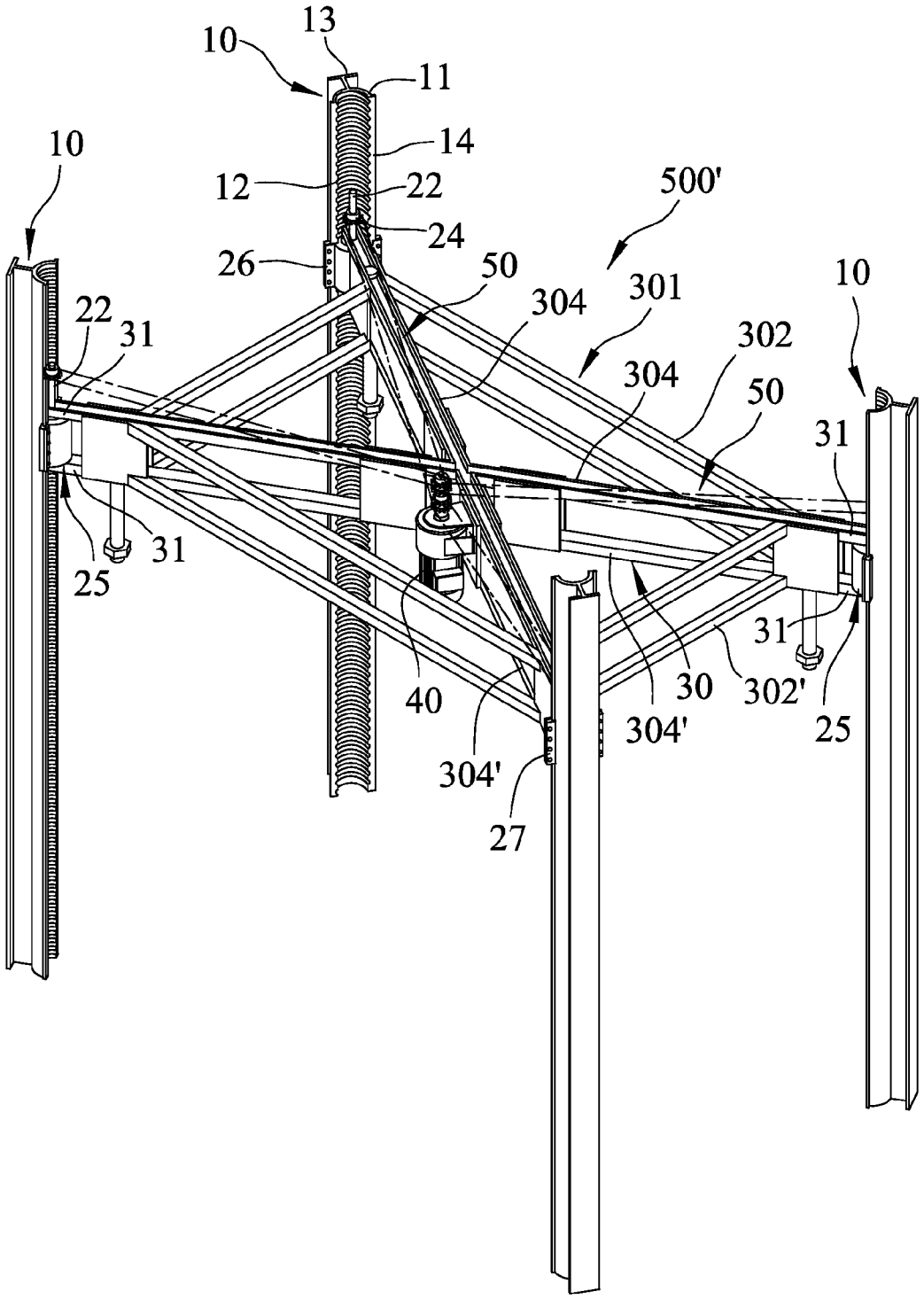
FIG. 8 is a perspective view of a lifting device according to another preferred embodiment of this invention.
Figure 9:
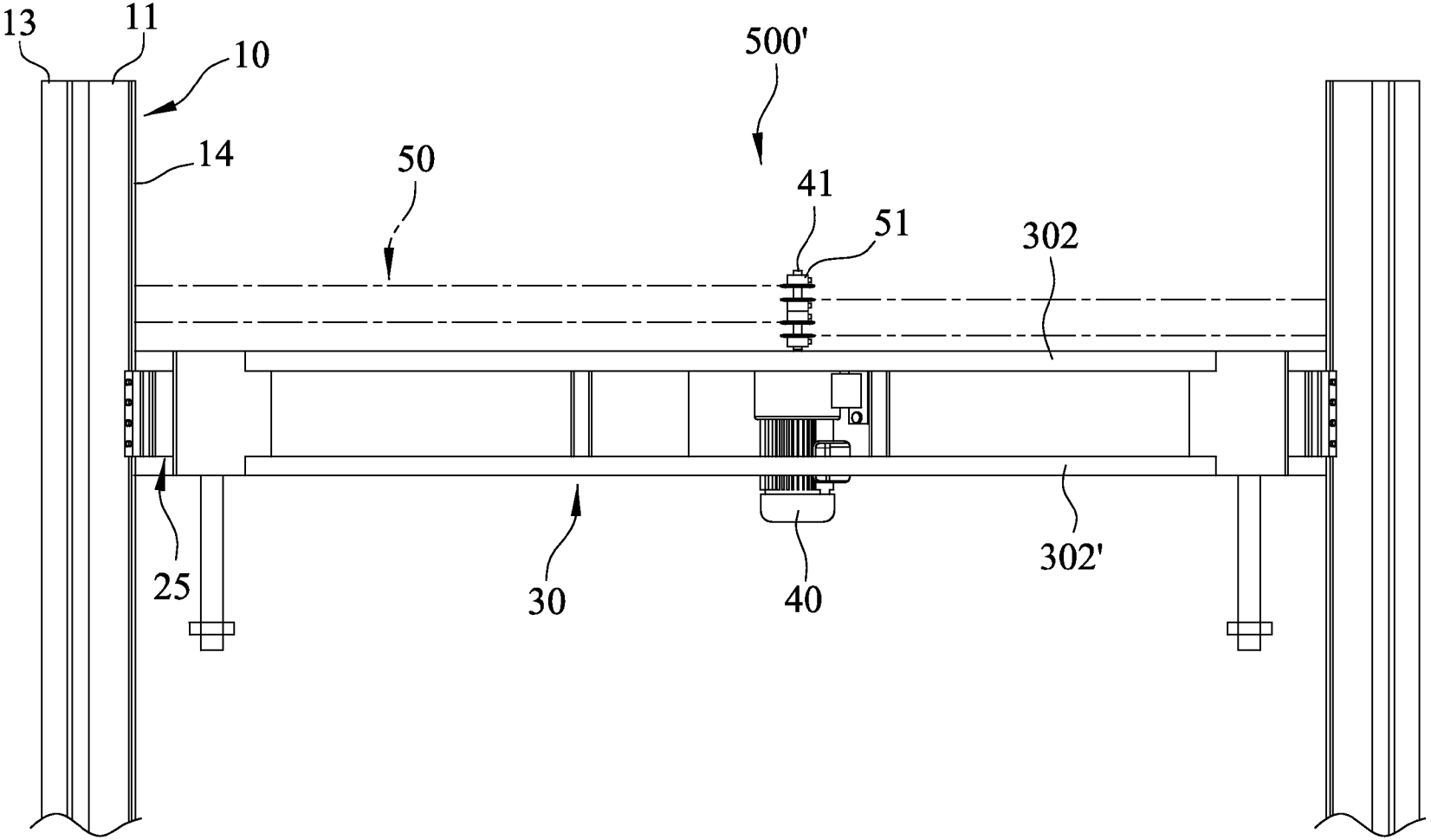
FIG. 9 is a fragmentary schematic side view of FIG. 8.
Figure 10:
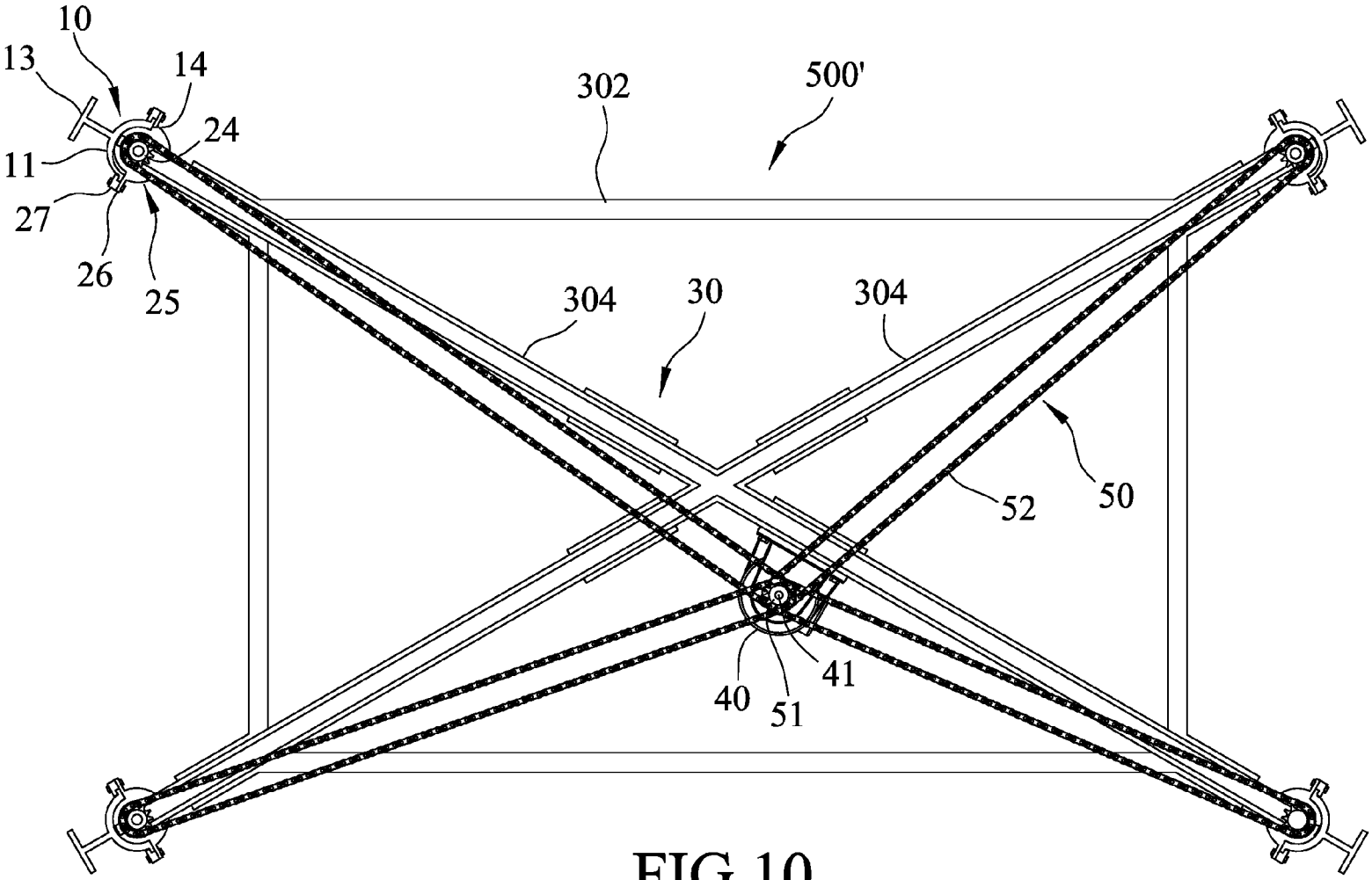
FIG. 10 is a schematic top view of FIG. 8.

Referring to FIGS. 8 to 10, another preferred embodiment of the lifting device 500' of the present invention is shown to be similar to the lifting device 500. However, in this embodiment, the lifting device 500' includes four vertical support structures 100, four rotation units 21 (see FIG. 1), four slide housings 25, a lift carrier 30, a drive motor 40, and four transmission units 50. The lift carrier 30 has a carrier frame structure 301 that consists of upper and lower structural frames 302, 302'. Each of the upper and lower structural frames 302, 302' includes two intersecting diagonal frame members 304, 304' having the connecting end portions 31. The connecting end portion 31 of each diagonal frame member 304 of the upper structural frame 302 is connected to a top side of the respective slide housing 25. The connecting end portion 31 of each diagonal frame member 304' of the lower structural frame 302' is connected to a bottom side of the respective slide housing 25. As such, the upper and lower structural frames 302, 302' can move upward and downward along with the slide housings 25 of the vertical support structures 10. The drive chain 52 of each transmission unit 50 is trained between the drive sprocket 51 of one of the transmission units 50 and the driven sprocket 24 of the respective rotation unit 21. Similarly, when the drive motor 40 is operated, the transmission units 50 respectively drive the rotation units 21 to rotate and move upward and downward along the helical groove halves 12 in the half tubes 11 of the respective vertical support structures 10 simultaneously.

In this invention, the half tube 11 of each vertical support structure 10 can be firmly secured on a wall surface or a surface of any fixed object through the mounting member 13. Further, according to usage requirements, the number of the vertical support structures 10 can be increased. When the drive motor 40 is operated so as to rotate the motor shaft 41, the rotation of the motor shaft 41 is transmitted to the drive sprockets 51, and the rotation of each drive sprocket 51 is transmitted through the drive chain 52 to the driven sprocket 24 of the respective rotation unit 21. Consequently, rotation of the driven sprocket 24 of each rotation unit 21 is transmitted through the rotating shaft 22 to the rotating block 211, thereby driving each rotation unit 21 to rotate and move upward and downward along the helical groove halves 12 in the half tube 11 of the respective vertical support structure 10. The lifting device 500 may be an elevator for loading people, a cargo lift, or a mechanical parking equipment.

In sum, each vertical support structure 10 is provided with the mounting member 13 that is connected to the outer surface of the half tube 11 thereof so that fixing and assembly thereof on a wall surface or a surface of any fixed object can be facilitated, thereby enhancing the stability of each vertical support structure 10. Further, each vertical support structure 10 is provided with the half tube 11 to facilitate interconnection of the vertical support structures 10 and to increase a moving path of each rotation unit 21, thereby achieving the purpose of enhancing the structural strength, connection convenience, and safe use of the lifting device 500, 500'.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A lifting device comprising:

a plurality of vertical support structures, each of which includes a half tube having an inner surface defining a receiving space and formed with a thread unit, and a mounting member connected to an outer surface of said half tube, said thread unit including a series of axially spaced-apart helical groove halves;

a plurality of rotation units, each of which is disposed in said receiving space and is movable along the length of said half tube, each of said rotation units being rotatably and threadedly engaged to said thread unit of said half tube of a respective one of said vertical support structures;

a plurality of slide housings respectively receiving said rotation units and respectively slidable relative to said half tubes of said vertical support structures to move upward and downward;

a lift carrier having a carrier frame structure disposed between said vertical support structures, said carrier frame structure including a plurality of connecting end portions connected to and riding on said slide housings, respectively;

a drive motor connected to said carrier frame structure; and a plurality of transmission units, each of which is connected between said drive motor and a respective one of said rotation units, wherein, when said drive motor is operated, said transmission units respectively drive said rotation units to rotate and move upward and downward along said helical groove halves in said half tubes of said vertical support structures simultaneously, wherein each of said rotation units includes a rotating block having an outer surface formed with a helical groove, a plurality of bearing balls received in said helical groove and engaged to said thread unit, a rotating shaft extending through said rotating block, and a driven sprocket mounted on said rotating shaft, said drive motor having a motor shaft, each of said transmission units including a drive sprocket mounted on said motor shaft, and a drive chain trained between said drive sprocket of one of said transmission units and said driven sprocket of the respective said rotation unit, and wherein said half tube further has two tube flanges projecting outwardly and radially from two radially opposite ends of said half tube and extending along the length of said half tube, each of said slide housings being substantially cylindrical and having two housing flanges that project outwardly and radially from two radially opposite ends of a corresponding one of said slide housings and that are slidable along said tube flanges.

2. The lifting device as claimed in claim 1, wherein each of said slide housings further has two slide bars respectively connected to said housing flanges and slidably engaged to said tube flanges.

3. The lifting device as claimed in claim 2, wherein each of said slide housings includes a substantially cylindrical accommodation space for accommodating said rotating block, a portion of each of said slide housings being received in said receiving space of said half tube of a respective one of said vertical support structures, each of said rotation units further including a shaft bearing disposed between said rotating shaft and an inner surface of a respective one of said slide housings, said rotating shaft having two opposite ends extending out of said slide housing, said sprocket being disposed externally of said slide housing.

4. The lifting device as claimed in claim 1, wherein said mounting member has a T-shaped cross section.

* * * * *